US006914589B2

(12) United States Patent
Choi

(10) Patent No.: US 6,914,589 B2
(45) Date of Patent: Jul. 5, 2005

(54) METHOD OF DRIVING FERROELECTRIC LIQUID CRYSTAL DISPLAY

(75) Inventor: Su Seok Choi, Hanam-shi (KR)

(73) Assignee: LG. Philips LCD Co., Ltd., Seoul (KR)

( * ) Notice: Subject to any disclaimer, the term of this patent is extended or adjusted under 35 U.S.C. 154(b) by 247 days.

(21) Appl. No.: 10/183,444

(22) Filed: Jun. 28, 2002

(65) Prior Publication Data

US 2003/0071776 A1 Apr. 17, 2003

(30) Foreign Application Priority Data

Oct. 13, 2001 (KR) ..... 2001-63199

(51) Int. Cl.[7] ..... G09G 3/36
(52) U.S. Cl. ..... 345/96; 345/97; 345/209
(58) Field of Search ..... 345/87–104, 204, 345/208–210

(56) References Cited

U.S. PATENT DOCUMENTS 4,976,515 A * 12/1990 Hartmann ..... 349/37
5,459,481 A * 10/1995 Tanaka et al. ..... 345/95
5,940,060 A * 8/1999 Raynes et al. ..... 345/97
5,959,600 A * 9/1999 Uchino et al. ..... 345/94
6,329,972 B1 * 12/2001 Yoo ..... 345/97

FOREIGN PATENT DOCUMENTS

EP 0558059 * 9/1993 ..... G09G/3/36
EP 0838802 A2 * 4/1998 ..... G09G/3/36

* cited by examiner

*Primary Examiner*—Lun-yi Lao
(74) *Attorney, Agent, or Firm*—McKenna Long & Aldridge LLP

(57) ABSTRACT

A method of driving a ferroelectric liquid crystal display with improved brightness while providing DC compensation. The method includes applying a data voltage, a compensation voltage, and a common voltage to each display pixel in each frame so as to selectively drive the liquid crystals, wherein the compensation voltage has a polarity (referenced to the common voltage) that is opposite the data voltage. The data voltage is applied for a longer period of time than the compensation voltage, but the magnitude of the compensation voltage is greater than the magnitude of the data voltage (when both are referred to the common voltage).

18 Claims, 4 Drawing Sheets

METHOD OF DRIVING FERROELECTRIC LIQUID CRYSTAL DISPLAY

This application claims the benefit of Korean Application No. P2001-63199, filed on Oct. 13, 2001, and which is hereby incorporated by reference.

BACKGROUND OF THE INVENTION

1. Field of the Invention

The present invention relates to liquid crystal displays, and more particularly, to a method of driving ferroelectric liquid crystal displays with improved contrast and brightness.

2. Discussion of the Related Art

Recently, liquid crystal displays (hereinafter abbreviated LCDs), which are low power consuming, low volume flat panel displays, have been replacing conventional cathode ray tubes in many applications. Liquid crystals having both liquid fluidity and optical crystal properties. LCDs operate by varying arrangement of liquid crystal using applied electric fields.

LCDs functionally include a liquid crystal panel and display drivers. The liquid crystal panel includes a lower (or array) substrate having pixel electrodes and thin film transistors arranged in a matrix, an upper (or common) substrate having a common electrode and color filter layers, and liquid crystal disposed between the upper and lower substrates.

There are different types of liquid crystals. For example, twisted nematic (TN) liquid crystals can be used to fabricate thin, low power, highly portable TN LCDs (twisted nematic liquid crystal displays). While beneficial in many respects, TN LCDs tend to have narrow viewing angles and relatively slow response times, thereby being rather unsuited for displaying high speed moving images.

Another type of liquid crystal is the ferroelectric liquid crystal (FLC). FLC has a property that enables in-plane switching of ferroelectric liquid crystal displays (FLCDs). In-plane switching can lead to improved viewing angles and faster response times as a result of spontaneous polarization. Therefore, FLCDs can have wide viewing angles and relatively fast response times. Thus, FLCDs are well suited for producing high speed moving images, thereby being a leading contender for next generation television sets.

FLCs themselves have various modes of operation, including the DHF (deformed helix FLC) mode, the SSFLC (surface stabilized FLC) mode, the AFLC (anti-ferroelectric LC) mode, the V type FLC mode (hereinafter abbreviated V mode), the Half-V type FLC mode (hereinafter abbreviated HV mode), and the like.

Much effort has gone into improving the FLC V mode because of it has advantages in gray realization and drive systems, and into improving the HV mode. Prototype V mode and HV mode LCDs have been reported.

HV mode is highly advantageous in that it enables a high contrast ratio, primarily owing to the superiority of its initial alignment state, suitability for active driving, and good temperature characteristics.

The initial alignment of the HV mode is established as follows. An electric field having a DC component that corresponds to a drive saturation voltage of the liquid crystal is applied between upper and lower electrodes during a phase transition (produced by temperature variation) of the liquid crystal from an initial N*state to an SmC* state. The applied electric field induces a spontaneous polarization direction along the applied electric field. Thereafter, unless disturbed (such as by an applied electric field), the liquid crystal molecules form a molecular arrangement along the spontaneous polarization direction induced by the initial alignment, thereby forming a uniform alignment state. For example, if the DC electric field used for initial alignment was negative (−), unless another potential is applied the liquid crystal molecules uniformly aligned in the directed induced by the negative (−) potential. Accordingly, when used in a display, the spontaneous polarization direction controls the alignment of the liquid crystal until a positive (+) electric field is applied. A negative (−) field has little or no effect on the liquid crystal. Thus, since only half of the possible electric fields significantly impact the liquid crystal alignment, the transmittance characteristic for applied data voltages is often called a Half-V (or HV as used herein) type FLC (cf. FIG. 3).

Meanwhile, the LCD display drivers include a central processor that outputs synchronous signals that are produced by processing video signals input from an external device. Additionally, a timing controller generates various timing signals required for image display from a synchronous signal output from the central processor. In particular, the timing controller produces a frame period, a basic time unit in which video data is displayed. Furthermore, a data drive part supplies data lines with output signals from a signal controller (based on outputs from the central processor), a gate drive part that sequentially applies scan voltages to the gate lines (based on outputs from the central processor), and a power supply that produces various required voltages. The On/off states of the thin film transistors (hereinafter abbreviated TFTs) depend on the voltages applied to the gate lines. In particular, a TFT channel opens when a TFT is turned on. Then, a pixel electrode is charged by the signal voltage on an associated data line. The result is video data displayed on the liquid crystal panel.

Specifically, the power supply produces a common voltage Vcom that is applied to the common electrode, and data drive part provides the liquid crystal panel with positive and negative video signals that represent an image that is to be produced by a pixel.

The positive and negative video signals are alternately applied as data voltages to the pixel (electrode), while a middle (between the positive and negative video signals) voltage, Vcom, is applied to the common electrode. This use of positive and negative video signals prevents the LC degradation that would result if only single polarity DC voltages were used.

The positive and negative video signals are not randomly applied. In practice there are a number of driving schemes that are used to prevent LC degradation. Those schemes include frame inversion, line inversion, column inversion, and dot inversion.

In dot inversion, both line and column inversions are used. This results in an improved image since flicker, an attribute of AC switching, tends to cancel out. In dot inversion the polarity of adjacent pixels differ.

FIG. 1 illustrates a drive waveform in a typical dot inversion method. Referring now to FIG. 1, the gate voltage Vscan determines the state of each TFT. For example, if a Vscan high voltage of 21V is applied to a gate, that gate is 'ON'. If a Vscan low voltage of −5V is applied, that gate is 'OFF'.

As shown, Vcom is a uniform DC waveform (and which is connected to the common electrode) and Vdata is a data voltage that is inverted, relative to Vcom, with the inversions occurring at a uniform rate according to a drive frequency that establishes frame periods. Vdata inversion compensates for the DC electric field accumulated in the previous frame so as to prevent ion accumulation in a liquid crystal (LC) cell, as well as LC degradation.

A nematic LC display driven by dot inversion has the transmittance T represented by the graphs shown in FIG. 2. As shown, the brightness (a function of transmittance) depends on the absolute magnitude of Vdata relative to Vcom. However, referring now to FIG. 3 and FIG. 4, the brightness of a HV mode FLC display depends on both the magnitude and on the direction of the applied electric field. In particular, one electric field polarity causes an increased brightness while the other polarity has little or no effect. This produces a brightness discontinuity. FIG. 3 and FIG. 4 shows a HV mode FLC display that responds only to a positive (+) polarity electric field. As shown, when driven by an alternating current Vdata signal the polarity of the electric field is inverted at a 1:1 ratio (Vcom as the reference voltage). Thus, an HV mode FLCD has a brightness that corresponds to half that of other LCDs.

Unfortunately, the method of driving a ferroelectric liquid crystal device according to the related art has problems. For example, when the initial aligmnent is achieved using a HV mode ferroelectric liquid crystal, that liquid crystals operate only with an electric field of one polarity. In particular, when the driving alternating current is inverted at a 1:1 ratio, bright and dark states alternate in each frame.

Hence, the equalized brightness is reduced to half that of a general nematic mode, which degrades image quality.

SUMMARY OF THE INVENTION

Accordingly, the present invention is directed to a method of driving a ferroelectric liquid crystal display that substantially obviates one or more problems due to limitations and disadvantages of the related art.

An object of the present invention is to provide a method of driving a ferroelectric liquid crystal display by manipulating the waveforms Vdata and Vcom, thereby improving the brightness of a ferroelectric liquid crystal that operates using the HV type transmittance-voltage (T-V) characteristic.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method of driving a ferroelectric liquid crystal display includes applying a data voltage (Vdata), a compensation voltage, and a common voltage (Vcom) to each pixel of a liquid crystal display in each frame so as to selectively drive the liquid crystals, wherein the compensation voltage has a polarity that is opposite that of the data voltage Vdata, with Vcom being a reference voltage.

Beneficially, the application time of Vdata is longer than the application time of the compensation voltage. Furthermore, the common voltage Vcom can be fixed or can vary in each frame period. Also beneficially, the integration over the applied time of the data voltage is equal to the integration over the applied time of the compensation voltage.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to illustrated embodiments of the present invention, examples of which are shown in the accompanying drawings. Wherever possible, the same reference numbers will be used throughout the drawings to refer to the same or like parts.

The present invention incorporates image data voltages and compensation voltages that are applied to data lines and that can improve display brightness while still preventing DC voltage degradation.

The present invention is directed to applications that use ferroelectric or anti-ferroelectric liquid crystals in single domain LC cells. Such cells have a helical structure that is initialized by simultaneously applying both temperature variations and an electric field. The spontaneous polarization direction is uniformly aligned by the applied electric field. Namely, the LC has a spontaneous polarization in a positive direction when a positive voltage is initially applied across the liquid crystal, or a spontaneous polarization in a negative direction when a negative voltage is initially applied across the liquid crystal.

If the LC is initially aligned by a negative voltage, the LC alignment is switched when a positive voltage is applied (thus varying the light transmittance). However, the LC alignment state does not vary (or varies little) from its initial alignment when a negative voltage is applied. Thus, an applied positive voltage represents image data (R, G, B) while an applied negative voltage is a compensation voltage that prevents degradation of the LC layer due to the applied positive voltage. What follows makes the assumption the LC is initially aligned by a negative voltage. Then, positive data voltages applied to the data line act are image data voltage signals while negative voltages applied to the data line act are compensation voltages. However, it should be understood that if the LC is initially aligned using a positive voltage that negative voltages will represent image data while positive voltages will represent compensation voltages.

Figure 1:
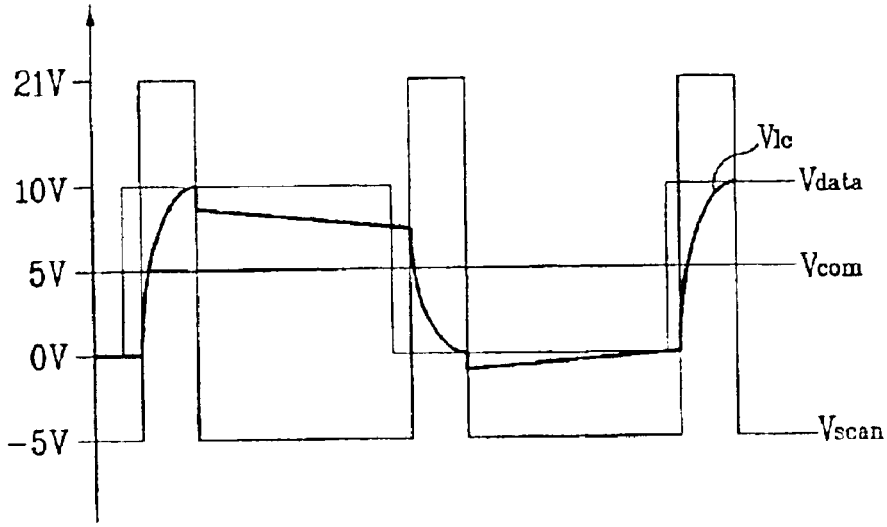
FIG.1 Related Art
FIG. 1 shows driving waveforms of a typical dot inversion method.
Figure 2:
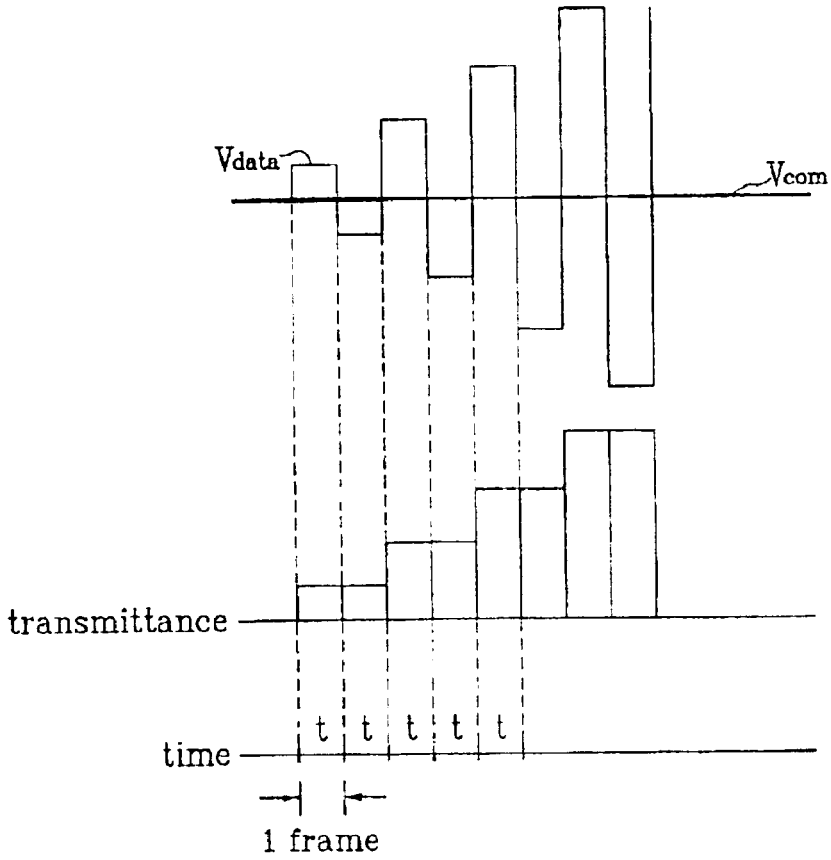
FIG.2 Related Art
FIG. 2 shows data voltages and the common voltage, plus the transmittance of a related art nematic liquid crystal display.
Figure 3:
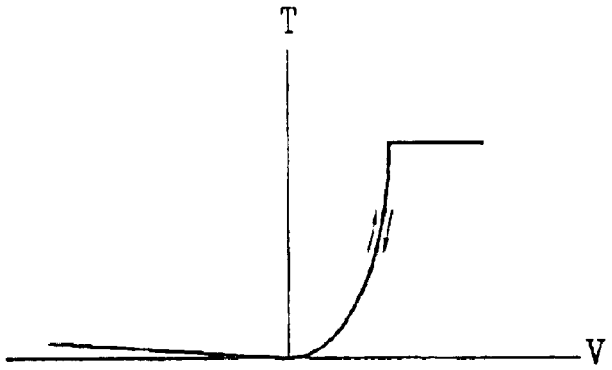
FIG. 3 Related Art
FIG. 3 shows the electric field verses transmittance curve of a related art HV mode ferroelectric liquid crystal.
Figure 4:
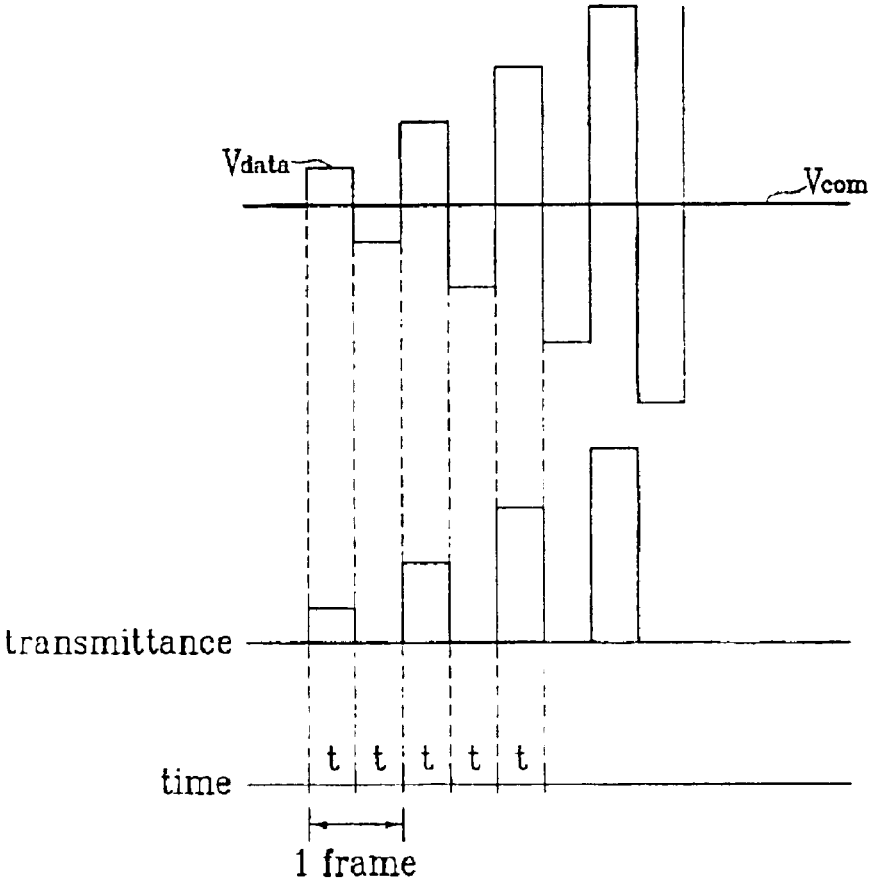
FIG. 4 Related Art
FIG. 4 shows data voltages and the common voltage, plus the transmittance of a related art ferroelectric liquid crystal display.
Figure 5:
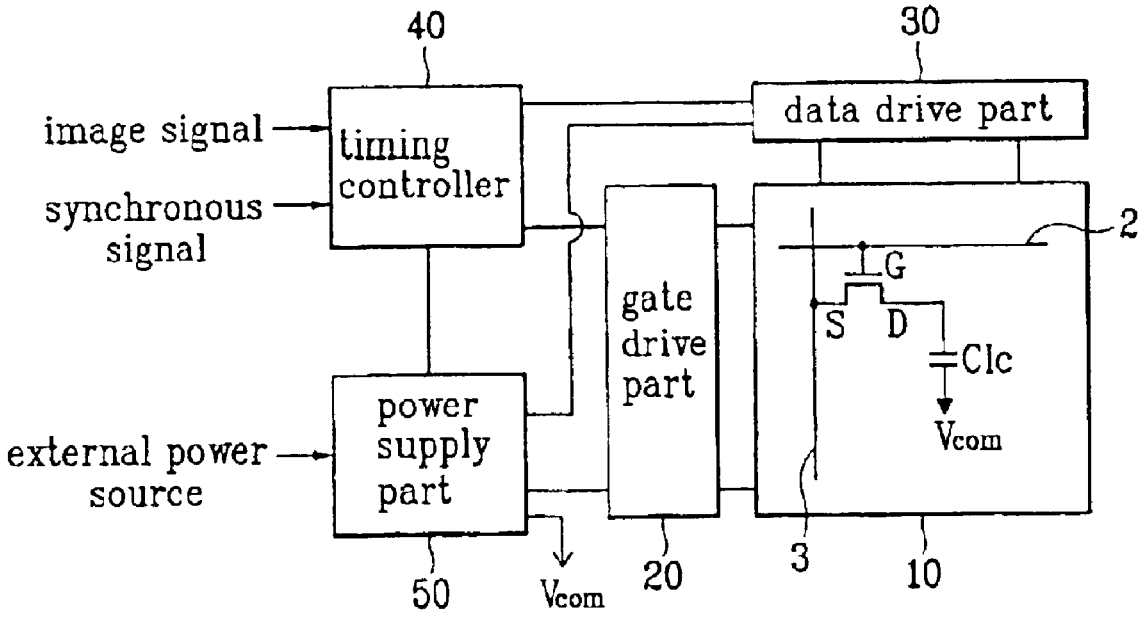
FIG. 5 shows a schematic diagram of an LCD drive circuit.
Figure 6:
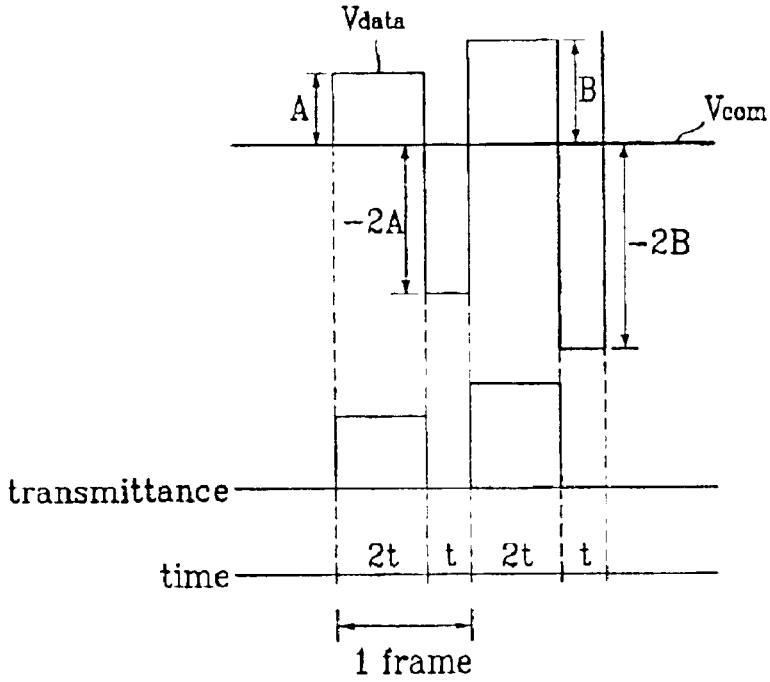
FIG. 6 illustrates a timing diagram of various signal waveforms according to a first embodiment of the present invention.
Figure 7:
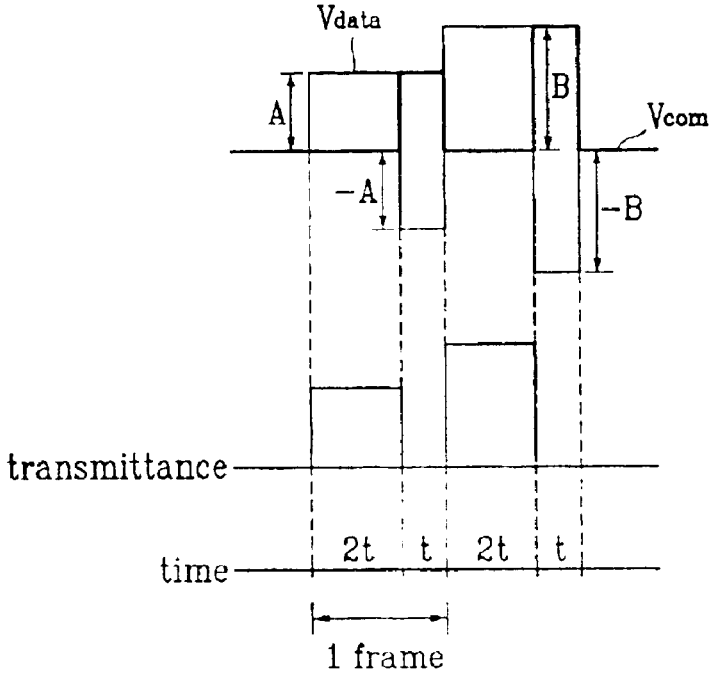
FIG. 7 illustrates a timing diagram of various signal waveforms according to a second embodiment of the present invention.

FIG. 5 illustrates a schematic diagram of a drive circuit of a typical LCD, FIG. 6 illustrates a timing diagram of signal waveforms according to a first embodiment of the present invention, and FIG. 7 illustrates a timing diagram of signal waveforms according to a second embodiment of the present invention.

Referring now to FIG. 5, a liquid crystal display generally includes a liquid crystal panel 10, a gate driving part 20, a data drive part 30, a timing controller 40, and a power supply part 50. The liquid crystal panel 10 includes gate lines 2, data lines 3, and a thin film transistor at intersections of the lines 2 and 3. The gate drive part 20 is connected to the gate lines 2 and determines the 'on/off' states of the thin film transistors by applying predetermined scan voltages to the gate lines 2. The data drive part 30 is connected to the data lines 3 so as to transfer data voltages and compensation voltages to the various pixels. The timing controller 40 receives external image signals and synchronous signals that control the timing of the gate and data drive parts 20 and 30. The power supply part 50, which is supplied with power from an external source, generates various power signals that applied to the liquid crystal panel 10.

The scan voltages are applied to the gate lines 2 so as to selectively turn on/off the thin film transistors. The scan voltages are periodically applied to the gate lines 2 such that first and second pulses are applied to each pixel in every frame. The first pulse applies image data (as a data voltage) while the second pulse applies a compensation voltage.

Meanwhile, the voltages (data and compensation) supplied through the data lines 3 are transferred from source S electrodes to drain electrodes D through channels that form when the thin film transistors turn on.

First Embodiment

A first embodiment of the present invention, shown in FIG. 6, has a uniform common voltage Vcom (that is, it is fixed). Positive data voltages and negative compensation voltages are selectively and alternatingly applied to the data lines. For convenience, since both data voltages and compensation voltages are applied to the same line, those voltages are jointly represented by the line Vdata. As shown, the positive data voltage is applied for a longer period of time than the negative compensation voltage. This improves the overall brightness by increasing the time that each pixel transmits light. However, in each frame the integrated value of the applied positive data voltage over time (with reference to Vcom) is matched by the integrated value of an applied negative compensation voltage over time (again, with reference to Vcom), with the negative compensation voltage being applied for a shorter period of time. Thus, the magnitude of the negative compensation voltage is greater than the magnitude of the positive data voltage. The two equal integration values prevent flicker from occurring as well as preventing liquid crystal degradation. Furthermore, residual images caused by DC electric field accumulation are also prevented. Beneficially, over time, the applied data voltages alternate polarity (relative to Vcom).

As discussed above, the image is substantially constructed by only the positive data voltage, while the negative compensation voltage compensates for the positive data voltage so as to minimize DC polarity effects.

An example may be helpful. Assume that the amplitude of the negative compensation voltage is twice the positive data voltage. Then, the positive data voltage should be applied for twice as long as the negative compensation voltage. FIG. 6 shows the time distribution between bright and dark states as 2:1 in each frame. However, the actual ratio should vary in accordance with the amplitudes of the data and compensation voltages.

Therefore, according to the first embodiment the image creating data potentials are applied for longer periods of time than the compensation voltage, while the common voltage Vcom is fixed at a predetermined potential. Additionally, the integration of the positive data compensation and negative compensation voltages (relative to the common voltage Vcom) are the same, thus the average voltage applied across the liquid crystal layer over time is zero (relative to the common voltage Vcom). Additionally, because the positive data voltage is applied for a longer period of time, the average display brightness increases. This is because HV type FLC (ferroelectric liquid crystals) having T-V characteristics controlled only by positive data voltages.

Second Embodiment

A second embodiment according to the present invention, illustrated in FIG. 7, uses a varying common voltage Vcom. In particular, as shown, the common voltage Vcom is greater when the (negative) compensation voltage is applied. Also as shown, the positive data voltages and the negative compensation voltages are applied in each frame. However, the positive data voltage is applied for a longer period of time in each frame than the negative compensation voltage. This improves overall brightness by enabling each pixel to transmit light for a greater period of time in each frame.

Specifically, scan voltages are applied to a plurality of gate lines that connect to the gate drive part. The scan voltages determine the 'on/off state of the thin film transistors. The scan voltages are applied for predetermined portions of a predetermined frame period. When the scan voltages correspond to a high level, the thin film transistor is turned on.

The scan voltages are applied such that first and second pulses are applied to each pixel in every frame. The first pulse represents actual image data, while the second pulse enables compensation of DC effects produced by the first pulse. As mentioned above, the data voltage and the compensation voltage pass through a channel between the source and drain electrodes when the gate receives an ON voltage. The passed voltages are applied across the liquid crystal layer by a pixel electrode that connects to the data line when an ON voltage is applied.

FIG. 7 illustrates waveforms when positive and negative data voltages are respectively applied for ⅔ and ⅓ of each frame. Again, for convenience, since both data voltages and compensation voltages are applied to the same line, those voltages are jointly represented by the line Vdata. The amplitudes of the positive and negative voltages, relative to the common voltage Vcom when a positive data voltage is applied, are equal. This reduces the required swing of the voltages on the data line from that required in the first embodiment of the present invention. Therefore, the second embodiment reduces the liquid crystal scan voltage and power consumption requirements.

Still referring to FIG. 7, the common voltage Vcom that is applied to the common electrode is different when a positive data voltage is applied than when a negative compensation voltage is applied. For example, as shown in FIG.

7, when a negative compensation voltage (again, the line Vdata represents both the positive data voltage and the negative compensation voltage) is applied the common voltage Vcom equal the magnitude of the positive data voltage. By increasing the common voltage Vcom it is unnecessary to increase the negative data voltage to achieve a greater difference between the common voltage Vcom and the negative data voltage. Thus, it is possible to make the integrated positive data voltage (relative to Vcom) over time equal to the integrated negative compensation voltage (relative to Vcom) over time, while having the positive data voltage applied longer in each frame period (which improves brightness), and without increasing the absolute magnitude of the negative data voltage. This reduces liquid crystal degradation and flicker.

Thus, it is possible to increase the average brightness of an HV FLC by applying the positive data voltage longer in each frame period while still providing DC compensation.

Accordingly, a method of driving a ferroelectric liquid crystal display according to the present invention has various advantages. First, the time that each pixel transmits light is increased. This increases the possible brightness over that in the related art HV type FLC display. Second, if the common voltage Vcom is changed it is possible to increase the difference between the common voltage and the compensation voltage without increasing the magnitude of the compensation voltage. Therefore, the required voltage swing on the data lines can be reduced. This enables a reduction in power consumption.

It will be apparent to those skilled in the art than various modifications and variations can be made in the present invention. Thus, it is intended that the present invention covers the modifications and variations of this invention provided they come within the scope of the appended claims and their equivalents.

What is claimed is:

1. A method of driving a ferroelectric liquid crystal display, comprising the steps of:

applying a common voltage to a common electrode;

applying a data voltage that represents image information to a pixel electrode for a first portion of a frame period, wherein the data voltage has a first polarity and a first magnitude relative to the common voltage; and applying a compensation voltage to the pixel electrode for a second portion of the frame period, wherein the compensation voltage has a polarity relative to the common voltage that is opposite the first polarity, and a second magnitude relative to the common voltage that is different from the first magnitude relative to the common voltage, and wherein a time integration of the first period and the first magnitude and the time integration of the second period and the second magnitude are substantially same.

2. The method of claim 1, wherein the common voltage is constant in the frame period.

3. The method of claim 2, wherein a liquid crystal alignment of the ferroelectric liquid crystal display is changed by the application of the data voltage so as to change the light transmittance through the ferroelectric liquid crystal display.

4. The method of claim 3, wherein the liquid crystal alignment of the ferroelectric liquid crystal display blocks light when the compensation voltage is applied.

5. The method of claim 2, wherein the second magnitude is greater than the first magnitude.

6. The method of claim 5, wherein the first portion has a longer time duration than the second portion.

7. The method of claim 2, wherein the first polarity is different in different frame periods.

8. The method of claim 1, wherein the common voltage changes in the frame period.

9. The method of claim 8, wherein a liquid crystal alignment of the ferroelectric liquid crystal display is changed by the application of the data voltage so as to change the light transmittance through the ferroelectric liquid crystal display.

10. The method of claim 9, wherein the liquid crystal alignment of the ferroelectric liquid crystal display blocks light when the compensation voltage is applied.

11. The method of claim 8, wherein the second magnitude is greater than the first magnitude.

12. The method of claim 11, wherein the first portion has a longer time duration than the second portion.

13. The method of claim 8, wherein the first polarity is different in different frame periods.

14. The method of claim 8, wherein the common voltage when the compensation voltage is being applied has the same absolute polarity as the data voltage.

15. A ferroelectric liquid crystal display, comprising:

an array substrate having a plurality of pixel electrodes, each pixel electrode being connected through a thin film transistor to a data line;

a common substrate having a common electrode;

liquid crystal interposed between the array substrate and the common electrode;

a common voltage source for applying a common voltage to the common electrode; and a data drive part for selectively applying a data voltage during a first portion of a frame period and a compensation voltage during a second portion of the frame period;

wherein the data voltage represents an image and has a first polarity and a first magnitude relative to the common voltage; and wherein the compensation voltage has a polarity relative to the common voltage that is opposite the first polarity and a second magnitude relative to the common voltage that is different from the first magnitude relative to the common voltage, and wherein a time integration of the first period and the first magnitude and the time integration of the second period and the second magnitude are substantially same.

16. A ferroelectric liquid crystal display according to claim 15, wherein the liquid crystal is selected from a group consisting of ferroelectric and anti-ferroelectric liquid crystals.

17. A ferroelectric liquid crystal display according to claim 15, wherein the common voltage source produces a fixed common voltage.

18. A ferroelectric liquid crystal display according to claim 15, wherein the common voltage source produces a common voltage that changes in each frame period.

* * * * *